United States Patent [19]

Nordeen

[11] 4,369,539

[45] Jan. 25, 1983

[54] POWERED FLOOR SWEEPER

[75] Inventor: Erwin E. Nordeen, St. Paul, Minn.

[73] Assignee: Whirlpool Corporation, Benton Harbor, Mich.

[21] Appl. No.: 223,099

[22] Filed: Jan. 7, 1981

[51] Int. Cl.[3] ..... A47L 11/18

[52] U.S. Cl. ..... 15/49 C; 15/41 R; 15/412

[58] Field of Search ..... 15/41 R, 41 A, 41 B, 15/42–48, 79 A, 79 R, 49 C, 50 C, 412, 182, 383

[56] References Cited

U.S. PATENT DOCUMENTS

| | | | |
|---|---|---|---|
| 258,343 | 5/1882 | Allen . | |
| 346,641 | 8/1886 | Castle . | |
| 631,837 | 8/1899 | Wilkins . | |
| 1,350,664 | 8/1920 | Merriman . | |
| 1,425,906 | 8/1922 | Sherbondy | 15/182 |
| 1,644,189 | 10/1927 | Hendricks | 15/50 C |
| 2,371,918 | 3/1945 | Rubin | 15/41 R |
| 2,512,544 | 6/1950 | Hammell . | |
| 2,611,913 | 9/1952 | Buquor | 15/41 R |
| 3,011,188 | 12/1961 | Menche | 15/49 C |
| 3,354,489 | 11/1967 | Ehrlich | 15/49 C X |
| 3,671,991 | 6/1972 | Fukuba | 15/41 R |
| 3,906,585 | 9/1975 | Mattsson | 15/41 R X |
| 3,909,869 | 10/1975 | Fukuba | 15/49 R |
| 4,094,033 | 6/1978 | Stein et al. | 15/41 R |
| 4,106,151 | 8/1978 | Cowdery et al. | 15/42 |

FOREIGN PATENT DOCUMENTS

| | | | |
|---|---|---|---|
| 2506956 | 8/1975 | Fed. Rep. of Germany | 15/49 C |

*Primary Examiner*—Edward L. Roberts

*Attorney, Agent, or Firm*—Wegner, McCord, Wood & Dalton

[57] ABSTRACT

A powered floor sweeper having a nozzle housing formed of a plurality of segments and tie elements extending through the segments for retaining the segments in assembled side-by-side relationship. The assembled segments define open ends closed by end caps also secured in the assembly by the tie elements. A pivotable door is secured to the nozzle housing by a tie element and cooperating retaining structure is provided on the door and assembled nozzles for retaining the door releasably in a position closing the dirt-collecting space of the nozzle housing. The device further includes a sweeper brush rotatably carried in the housing and a powered drive for forcibly rotating the brush. Internal baffles separate the sweeper brush bearing zone from the dirt-collecting space. The brush bristle tufts are arranged in preselected spaced relationship to effectively minimize and substantially preclude dust puffing in the operation of the floor sweeper.

17 Claims, 6 Drawing Figures

FIG. 1
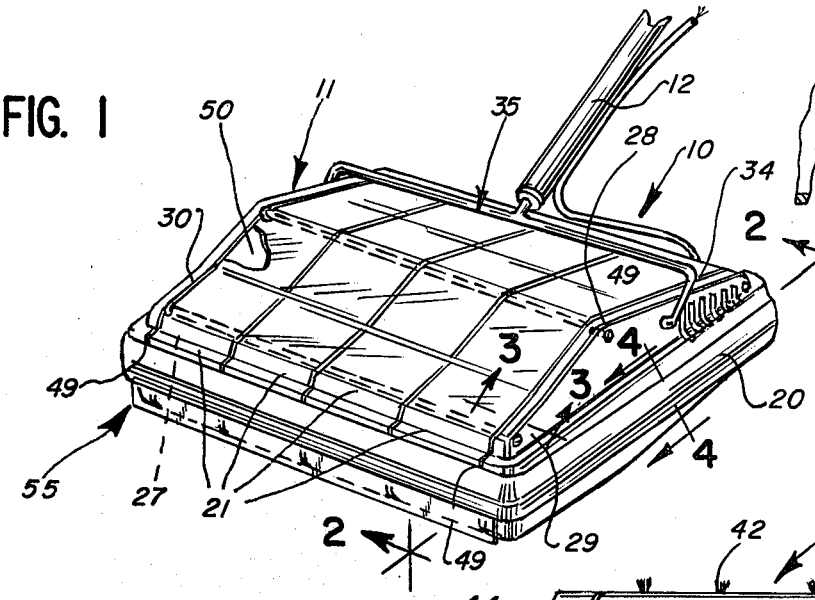
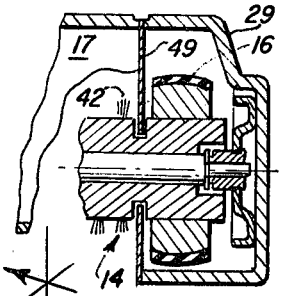
FIG. 3
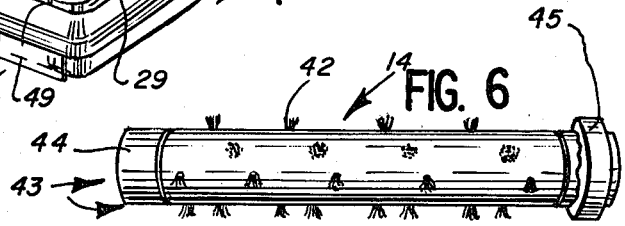
FIG. 6
FIG. 2
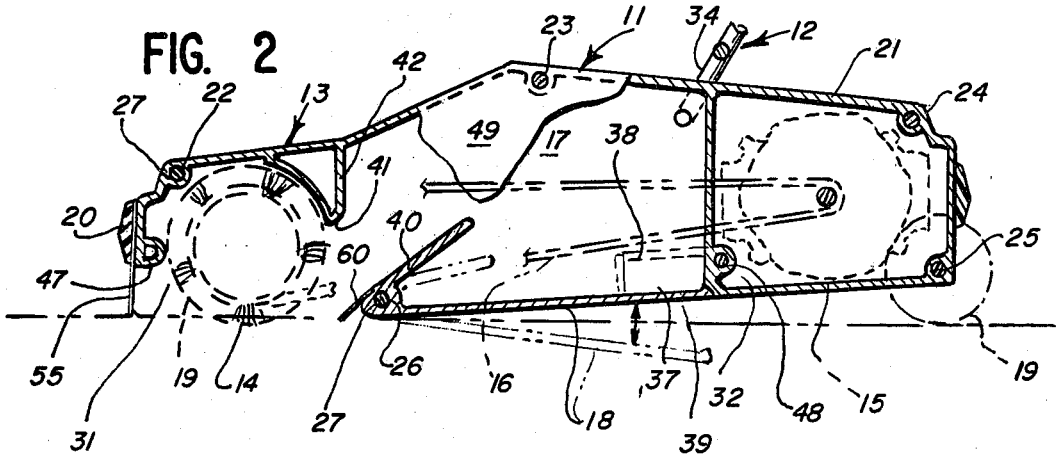
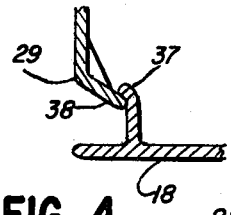
FIG. 4
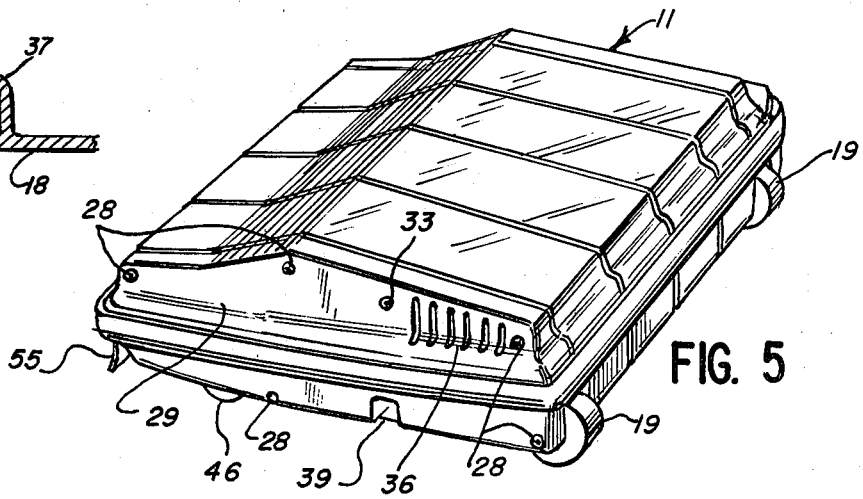
FIG. 5

POWERED FLOOR SWEEPER

BACKGROUND OF THE INVENTION

1. Field of the Invention

This invention relates to floor sweepers and in particular to powered floor sweepers.

2. Description of the Background Art

A number of different floor sweepers have been developed for sweeping a floor by moving a grilled housing on the floor surface to be cleaned while rotating a brush within the housing to sweep dirt from the floor surface into a collecting space within the housing. One example of such a floor sweeper is shown in U.S. Pat. No. 2,611,913 of Adolph P. Buquor.

Hiroshi Hukuba et al show, in U.S. Pat. No. 3,909,869, a floor sweeper having both a belt brush and a cylindrical brush.

Ray Cowdery et al show, in U.S. Pat. No. 4,106,151, a carpet sweeper provided with a plurality of sweeper units connected to a handle by an intermediate member having a plurality of legs attached one each to the different sweeper units.

A number of different brushes have been developed for use in such carpet sweepers, including those shown in U.S. Pat. No. 258,343 of Charles O. Allen; U.S. Pat. No. 346,641 of Wm. H. Castle; U.S. Pat. No. 631,837 of Alexander G. Wilkins; U.S. Pat. No. 1,350,664 of Grove R. Merriman; U.S. Pat. No. 2,512,544 of Kemper M. Hammell; and U.S. Pat. No. 3,906,585 of Bo Gunnar Mattsson.

In U.S. Pat. No. 3,671,991 Hiroshi Fukuba discloses a carpet sweeper having a rotary brush rotated by a driven wheel in friction contact with the wheel being driven on the floor. The body case defines a dust-collecting space with the elements of the case being assembled along the axial direction of the rotary brush.

Klaus Stein et al show in U.S. Pat. No. 4,094,033 a carpet sweeping device having a flow pattern for the cooling air of the drive motor. The air moving means comprises a blower element mounted on the shaft of the motor and partition means are provided on the housing for guiding the air, as desired.

SUMMARY OF THE INVENTION

The present invention comprehends an improved floor sweeper appliance having a low cost nozzle housing construction and improved brush means.

More specifically, the floor sweeper appliance of the present invention is provided with an improved nozzle housing for housing the sweeper brush and defining a dirt-collecting space, the housing comprising a plurality of similar wall segments and tie rod means extending through the segments for retaining the segments in assembled side-by-side relationship. The nozzle housing may include end caps secured to opposite sides of the assembled segments and baffles within the housing for laterally closing the dirt-collecting space.

The end caps, in the illustrated embodiment, are secured to the sides of the assembly by tie rods extending transversely thereacross.

A pair of baffles are disposed between the sweeper brush bearings and the dirt collecting space in parallel relation with the end caps.

The segments further define means forming a motor space for housing a motor for forcibly rotating the sweeper brush.

The housing, in the illustrated embodiment, is provided with a pivotally mounted door for releasably closing the dirt-collecting space.

Cooperating retaining means are provided on the door and segments for releasably retaining the door in closed position across the dirt-collecting space.

The invention further comprehends the provision of a sweeper brush rotatably carried in the nozzle housing for sweeping dirt into the dirt-collecting space thereof, the brush having a mounting cylinder and a plurality of widely separated bristle tufts projecting radially outwardly therefrom, and powered drive means for forcibly rotating the brush to sweep dirt into the collecting space in the use of the appliance.

In the illustrated embodiment, the tufts are arranged in circumferentially spaced, rectilinear rows of widely spaced tufts.

In the illustrated embodiment, the tufts of each row are disaligned with the tufts of the next adjacent rows.

The floor sweeping appliance of the present invention is extremely simple and economical of construction while yet providing an improved, low cost nozzle housing arrangement and an improved power driven sweeper brush structure.

BRIEF DESCRIPTION OF THE DRAWING

Other features and advantages of the invention will be apparent from the following description taken in connection with the accompanying drawing wherein:

FIG. 1 is a fragmentary perspective view of a floor sweeper embodying the invention with portions of the sweeper broken away to show details;

FIG. 2 is a fragmentary vertical section taken substantialy along the line 2—2 of FIG. 1;

FIG. 3 is a fragmentary sectional elevation along the line 3—3 of FIG. 1;

FIG. 4 is a fragmentary sectional elevation along the line 4—4 of FIG. 1;

FIG. 5 is a perspective view of the floor sweeper with the handle removed looking from the left rear thereof; and FIG. 6 is an elevation of the improved power driven brush of the floor sweeper.

DESCRIPTION OF THE PREFERRED EMBODIMENT

In the exemplary embodiment of the invention as disclosed in the drawing, a floor sweeper generally designated 10 is shown to comprise a nozzle housing generally designated 11 to which is swingably mounted a handle 12. Mounted within a forward portion generally designated 13 of the housing 11 is a brush 14 which may be suitably driven by an electric motor 15 and an interconnecting drive belt 16.

As shown in FIG. 2, the housing 11 defines rearwardly of the brush 14 a dirt-collecting space 17, the bottom of which is selectively closed by a door 18.

Housing 11 is provided with suitable rear wheels 19 and front wheels 46 for rolling movement of the floor sweeper on the surface of the floor to be cleaned. A suitable resilient bumper 20 may be extended about the housing, as shown in FIG. 1, for preventing damage to objects inadvertently struck by the floor sweeper in the use thereof.

Nozzle housing 11 is formed of a plurality of segments 21, each having a generally tubular, hollow cross section, as shown in FIG. 2, and held in side-by-side relationship, as illustrated in FIG. 1, and defining the nozzle and cover plate structure of the housing. More specifically, as illustrated in FIG. 2, the segments 21 define spaced bores 22, 23, 24, 25, 26, 47, and 48 through which are extended suitable tie rods 27 for retaining the segments in side-by-side disposition, as illustrated in FIG. 1. The tie rods include suitable threaded end portions 28 for securing a pair of end caps 29 and 30 to the opposite sides of the assembled segments.

As illustrated in FIG. 2, the segments cooperatively define a brush-receiving space 31 in the front portion 13 of the housing, the dirt-collecting space 17 in the mid-portion of the housing, and the motor-receiving space 32 in the rear portion of the housing. End caps 29 and 30 close the lateral ends of the space 31 and the outer end of the motor space 32.

A baffle 49 is located between the end cap 29 and the adjacent segment 21, and a baffle 50 is located between the end cap 30 and the adjacent segment. The baffle 49 shields the sweeper brush bearing, drive belt, and belt pulley zones from the dirt-collecting space 17, and the baffle 50 shields the brush bearing area at the end of the brush opposite the belt pulley from the dirt-collecting space 17.

As shown in FIG. 5, the end caps may be provided with a suitable aperture 33 for receiving the turned end 34 of the handle support 35, for free swinging movement of the handle about the axis of the apertures 33. As shown in FIG. 3, the sidewall 29 may be provided with suitable vent openings 36 for venting motor space 32.

As seen in FIG. 2, door 18 is hingedly or pivotally mounted in the housing on the tie rods extending through bores 26. The door includes, at its opposite sides, a pair of friction elements 37 frictionally engaging shoulders 38 on the end caps 29 and 30 for releasably frictionally retaining the door in the closed position of FIG. 2. When it is desired to remove dirt from the dirt-collecting space, the user merely urges the door to pivot downward about a tie rod 27 in bore 26 from the closed position to an open position for facilitated dirt removal by suitable fingertip manipulation of a projecting flange 39 on the door. The door further includes a wall portion 40 angled away from the brush-collecting space 31 so as to define a guide passage 41 with a projecting portion 42 on the segment front portion 13 rearwardly of the brush space 31.

Thus, the cooperating housing segments and tie rods provide a rigid nozzle housing for the floor sweeper while at the same time providing means for pivotally mounting the dirt-collecting space door and retaining the end caps in position at the opposite sides of the segment assembly.

The lower front edge of the nozzle housing 11 is provided with a front edge strip 55 of flexible material, such as rubber, which is attached on its upper edge to the nozzle housing by a suitable glue or cement. The lower free edge of the strip extends downward to the surface which is being cleaned and flexes rearwardly and forwardly as the floor sweeper is pushed and pulled.

For bare floor cleaning the floor sweeper may also advantageously include a flexible sweep strip 60 mounted behind brush 14 and suitably secured to the wall portion 40 by cement or the like. The sweep strip 60 helps prevent solid particles thrown rearwardly by the sweeper from being thrown beneath rear portions of the sweeper by intercepting these solid particles and directing them into the dirt-collecting space 17.

As indicated briefly above, the invention further comprehends an improved sweeper brush 14 driven by the electric motor 15 and drive belt 16, as shown in FIG. 2. The brush is more specifically illustrated in FIG. 6 and is shown to include a plurality of bristle tufts 42 arranged in a plurality of rectilinear rows generally designated 43 spaced circumferentially about the axis of a cylindrical mounting cylinder 44.

As shown in FIG. 6, the individual bristle tufts 42 are widely spaced apart in each row 43 and the bristle tufts of each row are disaligned with the bristle tufts of the circumferentially next adjacent rows of tufts.

As shown in FIG. 6, the mounting cylinder 44 is provided with a belt pulley 45 at one end engaged by the belt 16 and driving the brush rotatably about the axis of the mounting cylinder which may be suitably journaled in the end caps 29 and 30 by conventional bearing means.

The improved brush construction 14 effectively minimizes, and substantially precludes, dust puffing which will occur with conventional suction-free floor sweepers wherein the brushes are provided with closely spaced bristles contacting the floor at the front end of the sweeper nozzle and where, as here, there is no vacuum force or suction generated air stream available to remove the dust stirred up by the floor sweeping operation. Thus, with the present invention an improved floor cleaning operation is obtained with no objectionable dust puffing.

Additionally, the front edge strip 55 helps further to eliminate any dust puffing in front of the floor sweeper since the depending strip provides a sealing curtain which moves ahead of the rotating brush along the surface being cleaned.

The housing segments may be formed of low cost molded synthetic resin so as to provide an extremely low cost housing structure. The housing segments may be provided with suitable baffles and dividing wall portions so as to provide the desired compartmentation of the nozzle housing as discussed above. In the illustrated embodiment, the door 18 extends the width of the segment assembly so as to provide free access to the dirt-collecting space.

The floor sweeper of the present invention permits the use of low cost tooling in the manufacture thereof while yet providing an improved lightweight, power driven sweeper action.

The foregoing disclosure of specific embodiments is illustrative of the broad inventive concepts comprehended by the invention.

I claim:

1. In a floor sweeping appliance having a rotatable sweeper brush, the improvement comprising:

a wheeled housing for housing the brush, said housing comprising a plurality of similar generally tubular, hollow wall segments having internal wall portions cooperatively defining separated brush mounting and dirt-collecting spaces, and tie rod means extending fully through the segments lengthwise thereof for retaining the segments in assembled side-by-side relationship.

2. The floor sweeping appliance of claim 1 wherein said housing includes end caps secured to opposite outer ends of the assembled segments for laterally closing said housing.

3. The floor sweeping appliance of claim 2 wherein said housing includes baffle means for laterally closing said dirt-collecting space.

4. The floor sweeping appliance of claim 3 wherein said housing includes bearing means for said rotatable brush and said baffle means separate said bearing means from said dirt-collecting space.

5. The floor sweeping appliance of claim 1 wherein said housing includes end caps secured to the opposite ends of the assembled segments for laterally closing said housing, said end caps being secured to said sides by said tie rods.

6. The floor sweeping appliance of claim 1 wherein said housing includes a front edge strip mounted to said housing ahead of said sweeper brush to provide a sealing curtain which moves ahead of the rotatable sweeper brush and seals against the surface being cleaned.

7. The floor sweeping appliance of claim 1 wherein said housing includes a flexible sweep strip mounted behind said sweeper brush to intercept dirt particles thrown rearwardly by said sweeper brush.

8. The floor sweeping appliance of claim 1 wherein the sweeper brush includes a mounting cylinder rotatably carried in said housing and a sparsely distributed plurality of bristle tufts on said mounting cylinder.

9. The floor sweeping appliance of claim 8 wherein said tufts are arranged in circumferentially spaced rectilinear rows of widely spaced tufts.

10. The floor sweeping appliance of claim 8 wherein said tufts are arranged in circumferentially spaced rectilinear rows of widely spaced tufts, the tufts of each row being disaligned with the tufts of the next adjacent rows.

11. The floor sweeping appliance of claim 8 wherein said rotating means comprises an electrical motor mounted within said housing adjacent said dirt-collecting space.

12. The floor sweeping appliance of claim 8 wherein the bristle tufts are arranged in a plurality of rectilinear rows spaced circumferentially about the axis of the mounting cylinder.

13. The floor sweeping appliance of claim 12 wherein the bristle tufts of each row are disaligned with the bristle tufts of the circumferentially next adjacent row of tufts.

14. The floor sweeping appliance of claim 1 wherein said nozzle housing includes a front edge strip mounted ahead of said sweeper brush, and a flexible sweep strip mounted behind said sweeper brush, the two strips helping to confine within the appliance dirt and dust thrown up by rotation of the brush.

15. The floor sweeping appliance of claim 1 further including means for effectively sealing the nozzle to the underlying floor adjacent said dirt transferring means.

16. In a floor sweeping appliance having a rotatable sweeper brush, the improvement comprising:

a wheeled housing for housing the brush and defining a dirt-collecting space, said housing comprising a plurality of similar wall segments, and tie rod means extending through the segments for retaining the segments in assembled side-by-side relationship, said segments further cooperatively defining a motor space, and said appliance including a motor for rotating said brush.

17. The floor sweeping appliance of claim 4 wherein said brush comprises a mounting cylinder and a plurality of widely spaced bristle tufts extending radially from said mounting cylinder.

* * * * *